US009169101B2

(12) United States Patent
Koyanagi et al.

(10) Patent No.: US 9,169,101 B2
(45) Date of Patent: Oct. 27, 2015

(54) IMAGE FORMING APPARATUS

(71) Applicant: KYOCERA Document Solutions Inc., Osaka-shi, Osaka (JP)

(72) Inventors: Tsuyoshi Koyanagi, Osaka (JP); Shinsaku Yoneda, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/328,239

(22) Filed: Jul. 10, 2014

(65) Prior Publication Data

US 2014/0319766 A1 Oct. 30, 2014

Related U.S. Application Data

(62) Division of application No. 13/855,418, filed on Apr. 2, 2013, now Pat. No. 8,820,742.

(30) Foreign Application Priority Data

Apr. 5, 2012 (JP) ..... 2012-086164

(51) Int. Cl.
*B65H 29/00* (2006.01)
*B65H 31/24* (2006.01)
(Continued)

(52) U.S. Cl.
CPC ..... *B65H 31/24* (2013.01); *B65H 29/60* (2013.01); *B65H 31/02* (2013.01); *B65H 31/22* (2013.01);
(Continued)

(58) Field of Classification Search
CPC ..... B65H 29/14; B65H 29/58; B65H 29/60; B65H 31/24; B65H 2404/261; B65H 31/02; B65H 31/22; B65H 2406/12; B65H 2405/332
USPC ..... 271/279, 207, 209, 211, 224
See application file for complete search history.

(56) References Cited

U.S. PATENT DOCUMENTS 3,957,264 A * 5/1976 Bach et al. ..... 271/287
3,977,667 A * 8/1976 Cross et al. ..... 271/289
(Continued)

FOREIGN PATENT DOCUMENTS

JP 05286632 11/1993
JP 05286632 A * 11/1993 ..... B65H 31/00
(Continued)

OTHER PUBLICATIONS

Office Action dated Jan. 29, 2014.
(Continued)

*Primary Examiner* — Prasad Gokhale
(74) *Attorney, Agent, or Firm* — Gerald E. Hespos; Michael J. Porco; Matthew T. Hespos

(57) ABSTRACT

An image forming apparatus includes a housing, a first discharge opening and a second discharge opening, a sheet discharge portion, a restricting member and a sheet discharge tray. The sheet discharge portion is connected at a position below the first discharge opening, and the sheet discharged through the first discharge opening is to be placed thereon. The restricting member stands up on a downstream side of the sheet discharge portion in a discharging direction of the sheet and can come into contact with a downstream end edge of the sheet discharged to the sheet discharge portion in the discharging direction. The sheet discharge tray includes a first fixing portion and a second fixing portion to be fixed to an upper end part of the restricting member and is attachable above the sheet discharge portion, and a sheet discharged through the second discharge opening is to be placed thereon.

8 Claims, 15 Drawing Sheets

(51) Int. Cl.

| | |
|---|---|
| ***B65H 31/02*** | (2006.01) |
| ***B65H 31/22*** | (2006.01) |
| ***B65H 29/60*** | (2006.01) |

(52) U.S. Cl.

CPC . *B65H 2301/4212* (2013.01); *B65H 2301/5144* (2013.01); *B65H 2405/1124* (2013.01); *B65H 2405/332* (2013.01); *B65H 2406/12* (2013.01); *B65H 2601/325* (2013.01); *B65H 2801/27* (2013.01)

(56) References Cited

U.S. PATENT DOCUMENTS

| | | | | | |
|---|---|---|---|---|---|
| 3,988,018 | A | * | 10/1976 | Tusso et al. | 271/289 |
| 4,328,963 | A | * | 5/1982 | DuBois et al. | 271/293 |
| 4,332,377 | A | * | 6/1982 | DuBois et al. | 271/293 |
| 4,466,608 | A | * | 8/1984 | DuBois et al. | 271/293 |
| 4,730,206 | A | * | 3/1988 | Sawada et al. | 399/405 |
| 5,217,219 | A | * | 6/1993 | Chung et al. | 271/293 |
| 7,481,425 | B2 | * | 1/2009 | Chikumoto | 271/164 |
| 7,547,015 | B2 | * | 6/2009 | Lee et al. | 271/213 |
| 8,783,679 | B2 | * | 7/2014 | Ono | 271/207 |
| 2014/0151957 | A1 | * | 6/2014 | Ono | 271/207 |
| 2014/0183811 | A1 | * | 7/2014 | Takenaka | 271/3.19 |

FOREIGN PATENT DOCUMENTS

| | | |
|---|---|---|
| JP | 09-034321 | 2/1997 |
| JP | 09-142716 | 6/1997 |
| JP | 2002-308511 | 10/2002 |
| JP | 2004-323163 | 11/2004 |
| JP | 2006-208490 | 8/2006 |

OTHER PUBLICATIONS

Japanese Office Action dated Jul. 29, 2014.

* cited by examiner

IMAGE FORMING APPARATUS

This application is based on Japanese Patent Application Serial No. 2012-086164 filed with the Japan Patent Office on Apr. 5, 2012, the contents of which are hereby incorporated by reference.

BACKGROUND

The present disclosure relates to an image forming apparatus for forming an image on a sheet and particularly to an image forming apparatus with a sheet discharge portion to which a sheet having an image formed thereon is to be discharged and a sheet discharge tray additionally attached above the sheet discharge portion.

A sheet discharge portion to which a sheet having an image forming process applied thereto is to be discharged is arranged in an image forming apparatus such as a copier, a printer, a facsimile machine or a complex machine having these functions. Particularly, in some image forming apparatuses, the sheet discharge portion is arranged on an upper surface portion of an image forming apparatus main body because of an advantage that discharged sheets are easily taken out. Further, by arranging another sheet discharge tray above and at a predetermined distance from the sheet discharge portion, the sheet discharge portions can be switched according to users.

Conventionally, a technology has been disclosed in which an image reading apparatus is arranged above and at a predetermined distance from an image forming unit and a sheet discharge portion to which a sheet is to be discharged is arranged on an upper surface portion of the image forming unit. A plurality of sheet discharge portions are provided by additionally attaching a sheet discharge tray between the sheet discharge portion and a lower surface portion of the image reading apparatus.

In the above technology, the sheet discharge tray added to the image forming apparatus includes a hook member projecting upward or downward from the sheet discharge tray at one end side in a tray width direction intersecting with an attaching direction of the sheet discharge tray. If projecting upward from the sheet discharge tray, the hook member is attached to the lower surface portion of the image reading apparatus. Further, if projecting downward from the sheet discharge tray, the hook member is mounted in a guide groove formed in the upper surface of the image forming unit.

If the hook member projects upward or downward from one end of the sheet discharge tray additionally attached to the image forming apparatus as described above, it may be broken when the sheet discharge tray is attached. Further, if the hook member projects upward, it is difficult for an operator to confirm a hook mounting portion arranged on the lower surface portion of the image reading apparatus and an attaching operation has taken time in some cases.

The present disclosure was developed to solve the above problem and an object thereof is to provide an image forming apparatus which enables easy attachment of a sheet discharge tray.

SUMMARY

An image forming apparatus according to one aspect of the present disclosure includes a housing with a standing wall, an image forming unit, a first discharge opening and a second discharge opening, a sheet discharge portion, a restricting member and a sheet discharge tray. The image forming unit is arranged in the housing and forms an image on a sheet. The first and second discharge openings are arranged on the standing wall while being vertically spaced apart, and the sheet having the image formed thereon is selectively discharged from the interior of the housing therethrough. The sheet discharge portion is connected to the standing wall at a position below the first discharge opening, and the sheet discharged through the first discharge opening is to be placed thereon. The restricting member stands up on a downstream side of the sheet discharge portion in a discharging direction of the sheet and can come into contact with a downstream end edge of the sheet discharged to the sheet discharge portion in the discharging direction. The sheet discharge tray includes a first fixing portion to be fixed to the standing wall and a second fixing portion to be fixed to an upper end part of the restricting member and is attachable above the sheet discharge portion, and a sheet discharged through the second discharge opening is to be placed thereon.

These and other objects, features and advantages of the present disclosure will become more apparent upon reading the following detailed description along with the accompanying drawings.

DETAILED DESCRIPTION

Hereinafter, one embodiment of the present disclosure is described with reference to the drawings. Note that, in the following description, a term "sheet" means a copy sheet, coated paper, OHP sheet, cardboard, postcard, tracing paper, another sheet material to be subjected to an image forming process or a sheet material to be subjected to any arbitrary process other than the image forming process.

Figure 1:
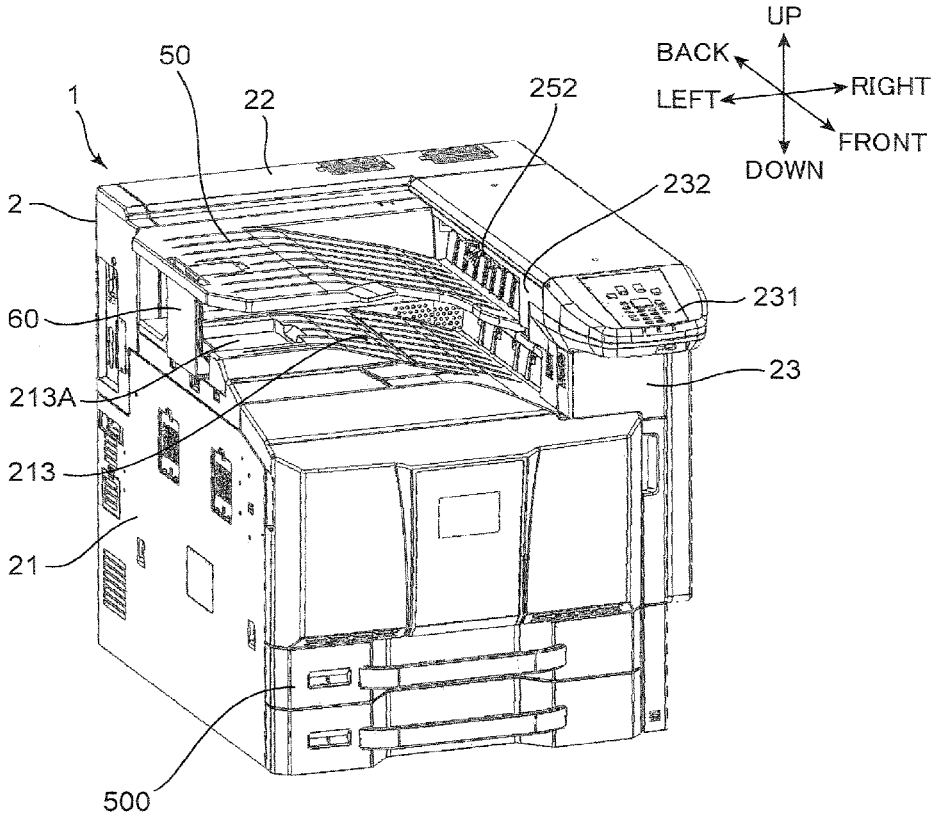
FIG. 1 is a perspective view of an image forming apparatus according to one embodiment of the present disclosure.
Figure 2:
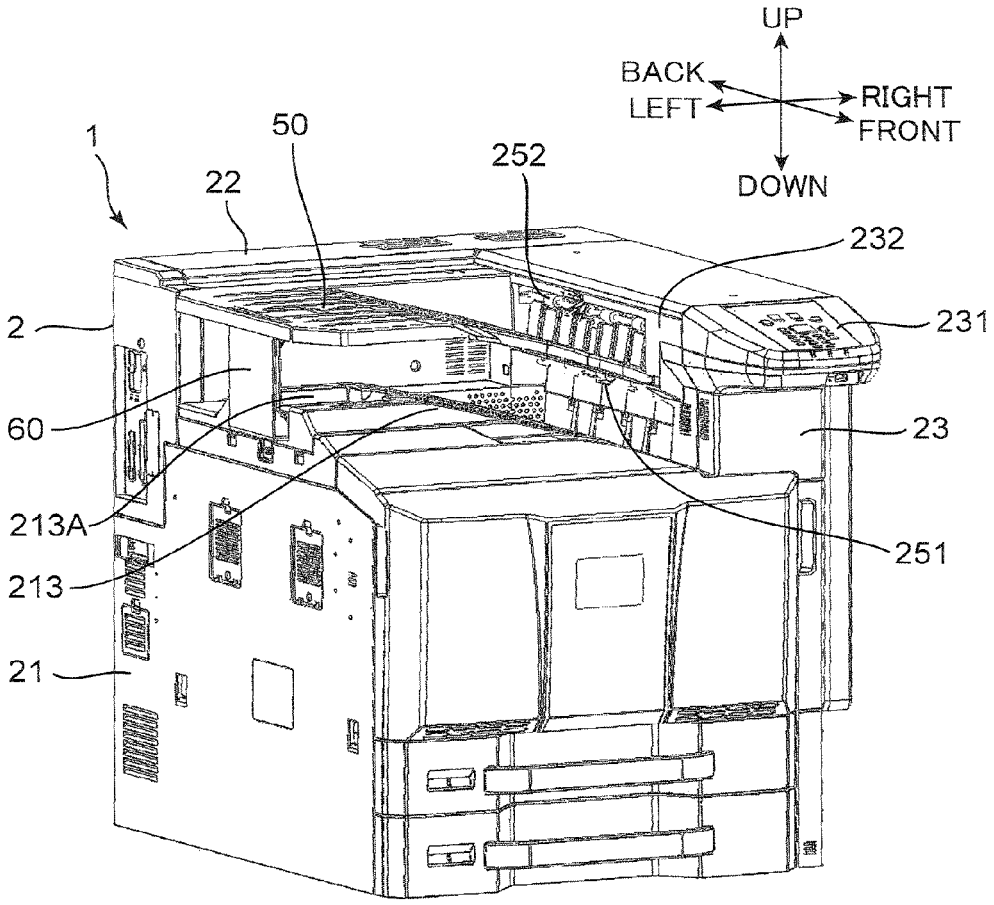
FIG. 2 is a perspective view of the image forming apparatus according to the embodiment of the present disclosure.
Figure 3:
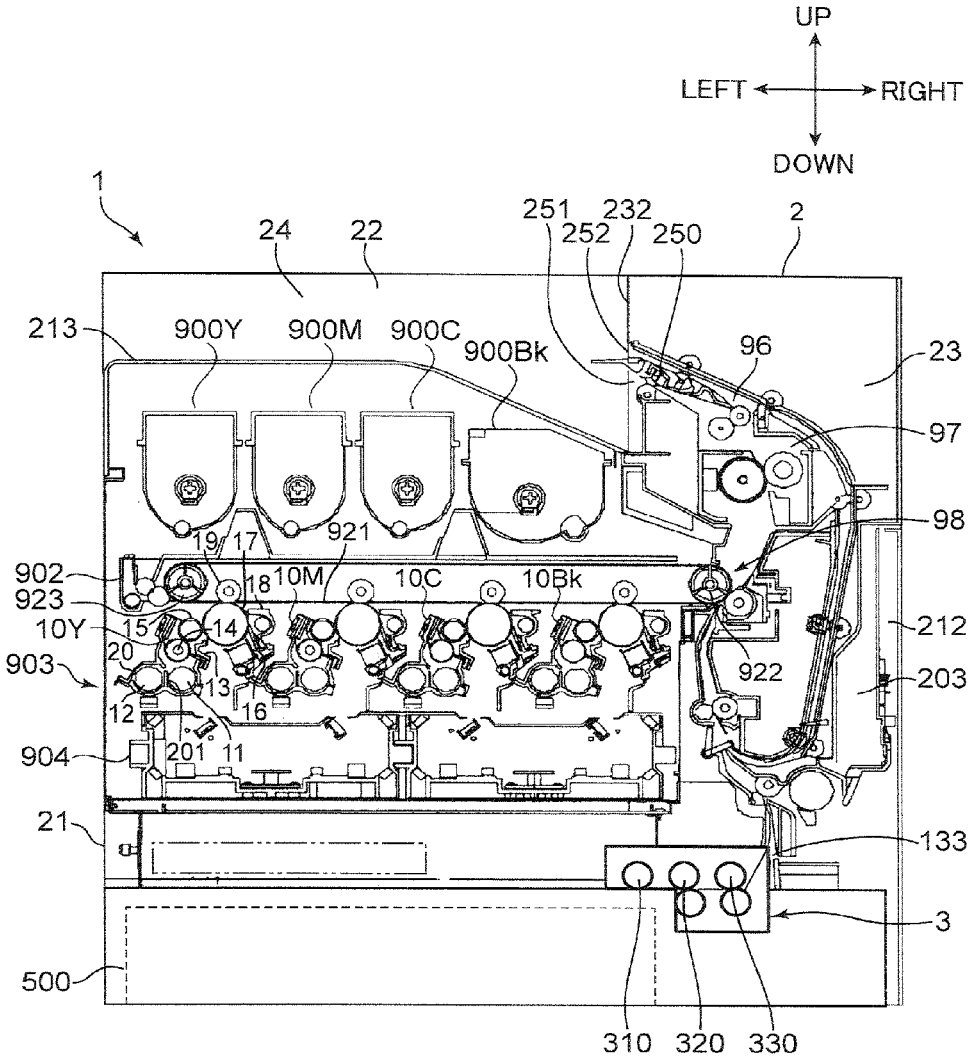
FIG. 3 is a sectional view showing the internal configuration of the image forming apparatus shown in FIGS. 1 and 2.

FIGS. 1 and 2 are perspective views of an image forming apparatus 1 according to the embodiment of the present disclosure. FIG. 3 is a sectional view schematically showing the internal configuration of the image forming apparatus 1 shown in FIGS. 1 and 2. The image forming apparatus 1 shown in FIGS. 1 to 3 is a printer of a top discharge type, but may be a copier, a facsimile machine, a multi-function machine with these functions or another apparatus for forming a toner image on a sheet in another embodiment. Particularly, if an unillustrated image reading apparatus is arranged above the image forming apparatus 1 according to the following embodiment, this apparatus functions as a copier of a so-called internal discharge type.

The image forming apparatus 1 forms an image on a sheet in accordance with image information transmitted from an image information transmitting apparatus such as a personal computer. The image forming apparatus 1 includes a substantially rectangular parallelepipedic main housing 2 (housing). The main housing 2 includes a substantially rectangular parallelepipedic lower housing 21, a substantially rectangular parallelepipedic rear wall portion 22 (side wall) standing up from a rear part of the lower housing 21, and a side wall portion 23 (standing wall) standing up from a right part of the lower housing 21. A sheet having a printing process applied thereto is discharged to a discharge space 24 (FIG. 3) enclosed by the lower housing 21, the rear wall portion 22 and the side wall portion 23.

An operation unit 231 projecting forward from the side wall portion 23 includes, for example, an unillustrated LCD touch panel. The operation unit 231 is so formed that information on an image forming process can be input. A user can input the number of sheets to be printed, print density and the like, for example, through the LCD touch panel.

A sheet tray 500 in which a plurality of sheets are stacked is arranged in the lower housing 21. The sheet tray 500 can be pulled out forward from the lower housing 21. A sheet P stored in the sheet tray 500 is fed upward in the lower housing 21, has an image forming process applied in the lower housing 21 and is discharged to the discharge space 24 based on an instruction input from the image information transmitting apparatus or input by a user through the operation unit 231.

A sheet discharge portion 213 and a sheet discharge tray 50 are arranged in the discharge space 24. A sheet having an image forming process applied thereto is discharged to either one of the sheet discharge portion 213 and the sheet discharge tray 50 according to an instruction input by the user or a condition set beforehand in the image forming apparatus 1. The sheet discharge portion 213 corresponds to an upper surface portion of the lower housing 21. Further, the sheet discharge tray 50 is attached above the sheet discharge portion 213 as a member separate from the main housing 2. The structure of the sheet discharge tray 50 is described in detail later.

Further, a tray 212 (FIG. 3) is rotatably attached to the right surface of the lower housing 21. The user can place a sheet on the tray 212 when the tray 212 is at a position to project to the right of the lower housing 21. Based on an instruction input by the user through the operation unit 231, the sheet on the tray 212 has an image forming process applied thereto and is discharged to the discharge space 24 after being pulled into the lower housing 21. When being rotated upward, the tray 212 is housed in a housing space 203 formed by recessing the right surface of the lower housing 21 to close a feed opening used to pull a sheet into the lower housing 21.

The lower housing 21 houses various devices for forming an image on a sheet. Further, the side wall portion 23 houses various devices for discharging a sheet having an image forming process applied thereto to the discharge space 24.

Toner containers 900Y, 900M, 900C and 900Bk, an intermediate transfer unit 902, an image forming unit 903, an exposure unit 904, a fixing unit 97 and a conveying unit 3 are housed in the lower housing 21. A sheet discharge unit 96 is arranged in the side wall portion 23.

The image forming unit 903 includes the yellow toner container 900Y, the magenta toner container 900M, the cyan toner container 900C and the black toner container 900Bk. Developing devices 10Y, 10M, 10C and 10Bk corresponding to respective YMCBk colors are respectively arranged below these containers.

The image forming unit 903 includes photoconductive drums 17 for bearing toner images of the respective colors. Photoconductive drums using an amorphous silicon (a-Si) based material may be used as the photoconductive drums 17. Yellow, magenta, cyan and black toners are respectively supplied to the respective photoconductive drums 17 from the toner containers 900Y, 900M, 900C and 900Bk.

A charger 16, a developing device 10 (10Y, 10M, 10C, 10Bk), a transfer roller 19 and a cleaning device 18 are arranged around each photoconductive drum 17. The charger 16 uniformly charges the surface of the photoconductive drum 17. The charged surface of the photoconductive drum 17 is exposed to light by the exposure unit 904, whereby an electrostatic latent image is formed. The exposure unit 904 irradiates laser beams based on a digital signal generated by the above image information transmitting apparatus. The developing devices 10Y, 10M, 10C and 10Bk respectively develop (visualize) electrostatic latent images formed on the respective photoconductive drums 17 using the toners of the respective colors supplied from the toner containers 900Y, 900M, 900C and 900Bk. The transfer roller 19 sandwiches an intermediate transfer belt 921 together with the photoconductive drum 17 to form a nip portion, and primarily transfers a toner image on the photoconductive drum 17 to the intermediate transfer belt 921. The cleaning device 18 cleans the circumferential surface of the photoconductive drum 17 after the transfer of a toner image.

Each of the developing devices 10Y, 10M, 10C and 10Bk includes a developer housing 20. Two-component developer containing magnetic carrier and toner is stored in the developer housing 20. Further, two agitating rollers 11, 12 are rotatably arranged in parallel near a bottom part of the developer housing 20 with an axial direction thereof aligned with a longitudinal direction.

A circulation path for the developer is set on the inner bottom surface of the developer housing 20 and the agitating rollers 11, 12 are arranged in the circulation path. A partition wall 201 standing up from the bottom part of the developer housing 20 extends in the axial direction between the agitating rollers 11 and 12. The partition wall 201 defines the circulation path. The circulation path is formed to circle around the partition wall 201. The two-component developer is charged while being agitated and conveyed along the circulation path by the agitating rollers 11 and 12.

The two-component developer is circulated in the developer housing 20 while being agitated by the agitating rollers 11 and 12, whereby the toner is charged. The two-component developer on the agitating roller 11 is conveyed while being attracted to a magnetic roller 14 located at an upper side. The attracted two-component developer forms a magnetic brush (not shown) on the magnetic roller 14. The magnetic brush has the layer thickness thereof restricted by a doctor blade 13 and supplies the toner to a developing roller 15 located above. A toner layer on the developing roller 15 is formed due to a potential difference between the magnetic roller 14 and the developing roller 15. An electrostatic latent image on the photoconductive drum 17 is developed by the toner layer.

The exposure unit 904 includes various optical devices such as light sources, polygon mirrors, reflecting mirrors and deflecting mirrors, and irradiates the circumferential surfaces of the photoconductive drums 17 provided in the image forming unit 903 with beams based on image data to form electrostatic latent images.

The intermediate transfer unit 902 includes the intermediate transfer belt 921, a drive roller 922 and a driven roller 923. Toner images from a plurality of photoconductive drums 17 are superimposed on the intermediate transfer belt 921 (primary transfer). The superimposed toner images are secondarily transferred to a sheet supplied from the sheet tray 500 or the tray 212 in a secondary transfer unit 98. The drive roller 922 and the driven roller 923 for driving and rotating the intermediate transfer belt 921 are rotatably supported on the lower housing 21.

The fixing unit 97 applies a fixing process to a toner image on a sheet secondarily transferred from the intermediate transfer unit 92. The sheet with the fixed color image is discharged toward the sheet discharge unit 96 formed above the fixing unit 97 (in the side wall portion 23).

The sheet discharge unit 96 discharges a sheet conveyed from the fixing unit 97 to the discharge space 24. The sheet discharge unit 96 includes a sheet discharge changing guide 250, a lower sheet discharge opening 251 (first discharge opening) and an upper sheet discharge opening 252 (second discharge opening). The lower sheet discharge opening 251 and the upper sheet discharge opening 252 are arranged in the side wall portion 23 while being spaced apart in a vertical direction, and a sheet having an image formed thereon is selectively discharged from the interior of the side wall portion 23. The upper sheet discharge opening 252 is arranged above the lower sheet discharge opening 251. The sheet discharge portion 213 described above is located below the lower sheet discharge opening 251.

The sheet discharge changing guide 250 is rotatably supported on the side wall portion 23. The sheet discharge changing guide 250 is rotated by an unillustrated controller according to a discharge destination of the sheet. If a right end part of the sheet discharge changing guide 250 is moved upward as shown in FIG. 3, the sheet is discharged to the sheet discharge portion 213 though the lower sheet discharge opening 251 from the fixing unit 97. On the other hand, if the right end part of the sheet discharge changing guide 250 is moved downward from a position shown in FIG. 3, a sheet is discharged to the sheet discharge tray 50 (FIG. 1) though the upper sheet discharge opening 252 from the fixing unit 97. Unillustrated sheet discharge rollers are arranged at the lower and upper sheet discharge openings 251, 252.

The conveying unit 3 is arranged to face the sheet tray 500 in the lower housing 21. The conveying unit 3 includes a pickup roller 310, feed rollers 320 and conveyor rollers 330. By driving and rotating the pickup roller 310 and the feed rollers 320 provided in the conveying unit 3, the uppermost sheet of a sheet stack in the sheet tray 500 is picked up one by one. Further, the sheet is conveyed to a downstream side of a sheet conveyance path 133 by the conveyor rollers 330 and introduced to the image forming unit 903. The pickup roller 310, the feed rollers 320 and the conveyor rollers 330 form a part of the sheet conveyance path 133 along which the sheet is conveyed to the image forming unit 903.

<Regarding Structure of the Sheet Discharge Tray 50>

Figure 4:
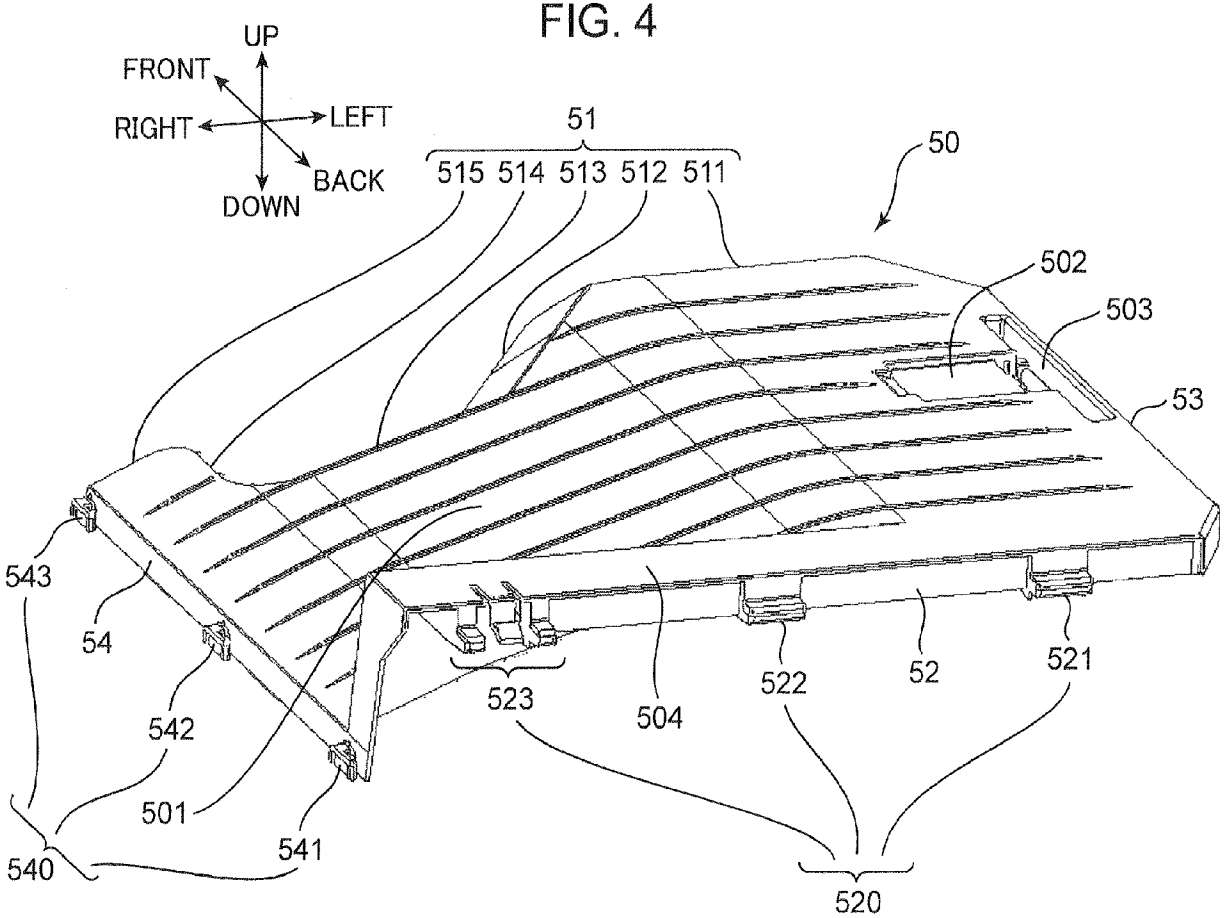
FIG. 4 is a perspective view of a sheet discharge tray according to the embodiment of the present disclosure.
Figure 5:
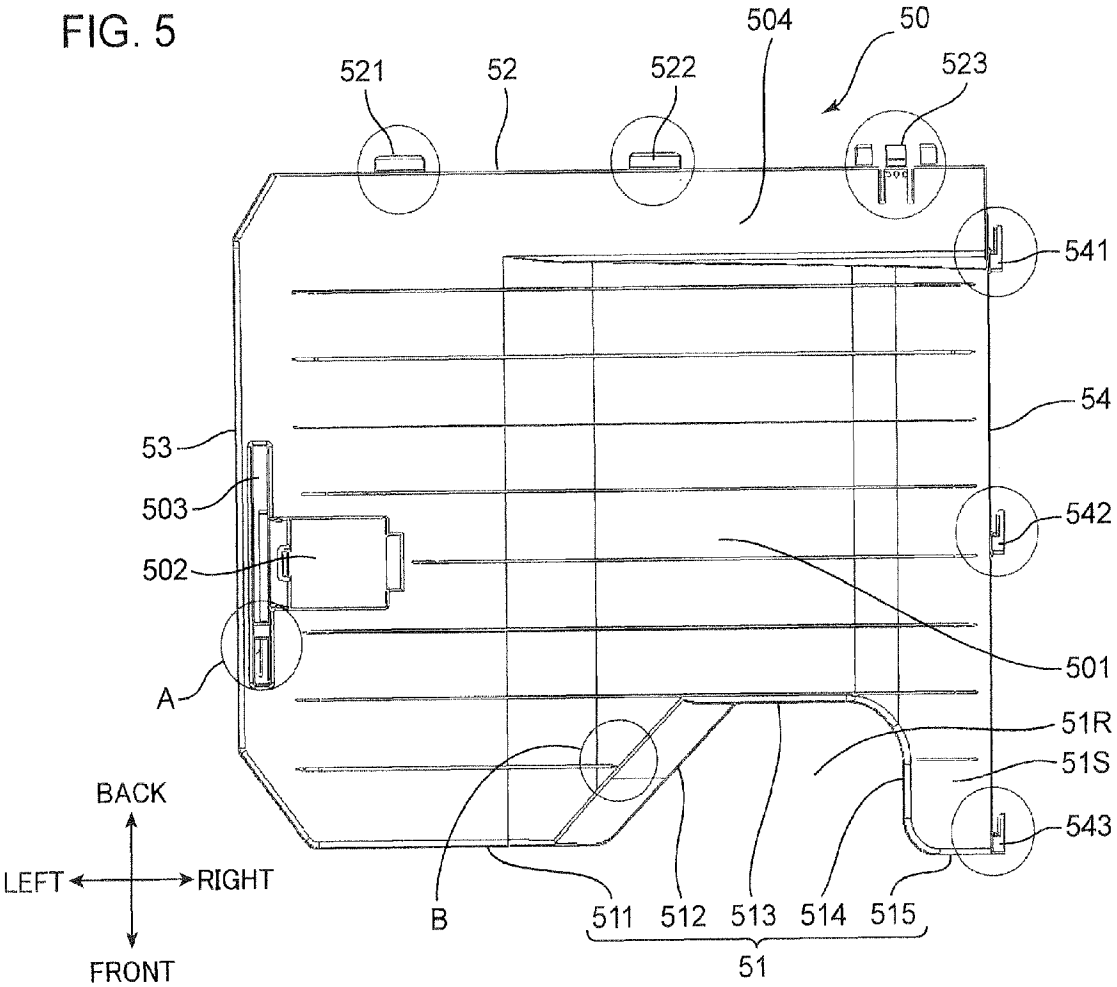
FIG. 5 is a plan view of the sheet discharge tray according to the embodiment of the present disclosure.
Figure 6:
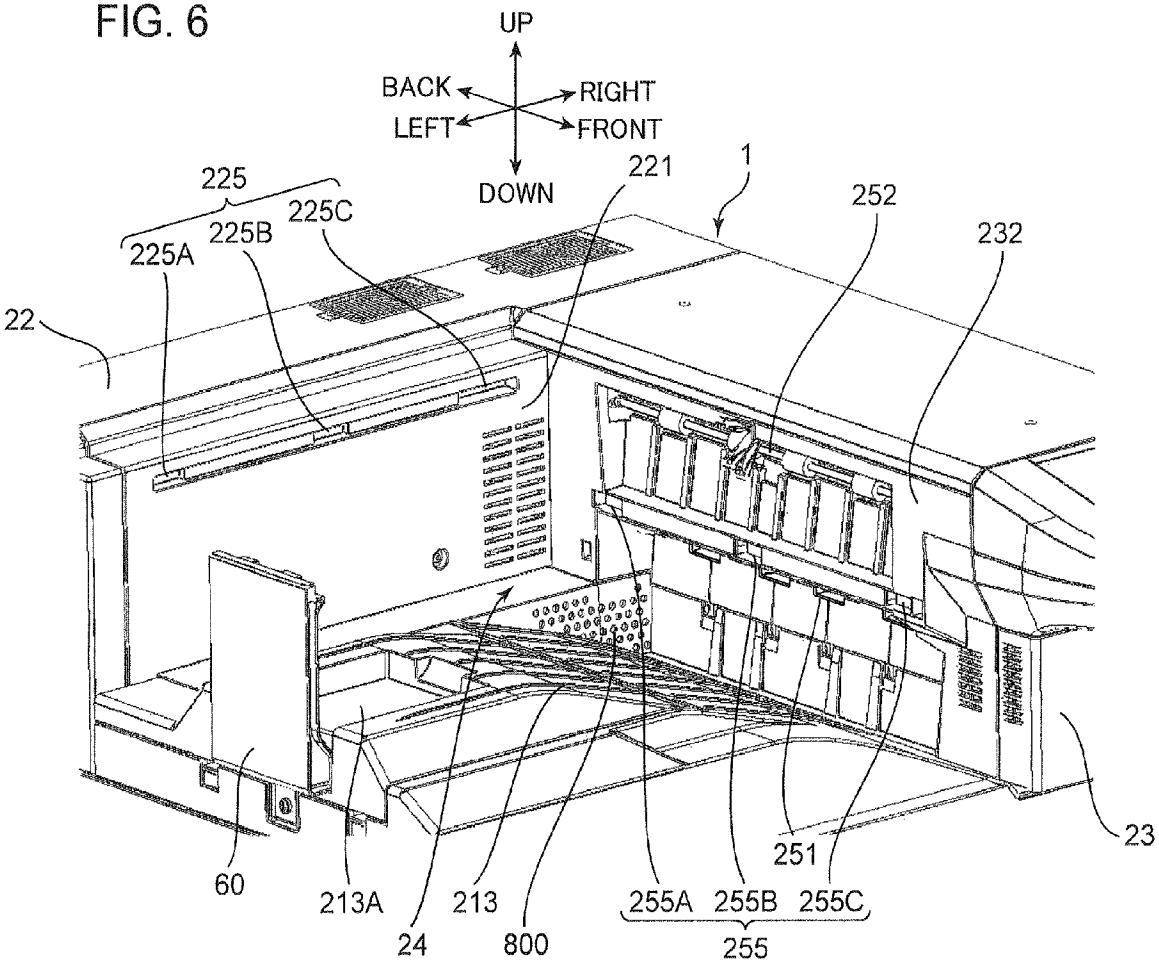
FIG. 6 is an enlarged perspective view of the image forming apparatus according to the embodiment of the present disclosure.

Next, the sheet discharge tray 50 according to this embodiment and its surrounding structure are described in detail with reference to FIGS. 4 to 6. FIG. 4 is a perspective view of the sheet discharge tray 50 according to this embodiment. FIG. 5 is a plan view of the sheet discharge tray 50. FIG. 6 is an enlarged perspective view of the upper surface portion of the image forming apparatus to which the sheet discharge tray 50 is to be attached.

With reference to FIGS. 4 and 5, the sheet discharge tray 50 is a substantially plate-like member extending in forward and backward directions and lateral direction. The front, rear, left and right sides of the sheet discharge tray 50 are defined by a tray front wall 51, a tray rear wall 52, a tray left wall 53 and a tray right wall 54. An upper sheet discharge surface 501 is arranged on the upper surface of the sheet discharge tray 50. As described above, when the sheet discharge tray 50 is attached to the main housing 2, a sheet having a fixing process applied thereto is discharged onto the upper sheet discharge surface 501.

The tray front wall 51 is a thin wall portion defining the front edge of the sheet discharge tray 50 and includes a first front wall 511, a second front wall 512, a third front wall 513, a fourth front wall 514 and a fifth front wall 515. The first front wall 511 extends from the left end to a substantially central part of the tray front wall 51. The second front wall 512 extends at a predetermined angle from the right end of the first front wall 511 toward a right rear side. The third front wall 513 extends rightward from the right end of the second front wall 512. The fourth front wall 514 extends forward from the right end of the third front wall 513 via a curved portion. Further, the fifth front wall 515 extends rightward from the front edge of the fourth front wall 514 via a curved portion. A cut portion 51R (FIG. 5) is formed on the front side of the sheet discharge tray 50 by the second front wall 512, the third front wall 513 and the fourth front wall 514. A tray projecting portion 51S is arranged to the right of the cut portion 51R and on a front part of the sheet discharge tray 50. The cut portion 51R is formed in the sheet discharge tray 50 to make it easier for a user to grab the discharged sheet from below.

The tray rear wall 52 is a thin wall portion located on a side opposite to the tray front wall 51 and defining the rear edge of the sheet discharge tray 50. A rear fixing portion 520 (first rear mounting piece 521, second rear mounting piece 521, third rear mounting piece 523) (third fixing portion) is arranged on a left part, a central part and a right part of the tray rear wall 52. The first, second and third rear mounting pieces 521, 522 and 523 of the rear fixing portion 520 are respectively projecting pieces projecting backward from the tray rear wall 52. When the sheet discharge tray 50 is attached to the main housing 2, these mounting pieces are engaged with the rear wall portion 22. Note that since the third rear mounting piece 523 is in the form of a hook composed of three projecting pieces for the engagement of the sheet discharge tray 50 with the rear wall portion 22 when the sheet discharge tray 50 is attached. A central projecting piece of the third rear mounting piece 523 is formed to face the two projecting pieces on opposite ends via slits and elastically deformable in the vertical direction. Further, a protrusion projecting upward is formed near the leading end of the central projecting piece.

The tray left wall 53 is a thin wall portion defining the left edge of the sheet discharge tray 50. An upper recess 502 and a fixing recess 503 are arranged in a central part of the tray left wall 53 in forward and backward directions and on the inner side of the tray left wall 53. The upper recess 502 is formed by recessing a substantially square part of the upper sheet discharge surface 501 downwardly. The fixing recess 503 is continuous with the left end of the upper recess 502 and extends longer in forward and backward directions than the upper recess 502. The fixing recess 503 is also formed by recessing a part of the upper sheet discharge surface 501 downwardly. A fixing portion 50A to be described later is arranged on the underside (lower side) of the fixing recess 503.

The tray right wall 54 is a thin wall portion defining the right edge of the sheet discharge tray 50. A right fixing portion 540 (first right mounting piece 541, second right mounting piece 542, third right mounting piece 543) (first fixing portion) is arranged on a rear part, a central part and a front part of the tray right wall 54. The first, second and third mounting pieces 541, 542 and 543 of the right fixing portion 540 are respectively projecting pieces which project rightward from the tray right wall 54 and the leading ends of which are bent backward. When the sheet discharge tray 50 is attached to the main housing 2, these mounting pieces are engaged with the side wall portion 23.

With reference to FIG. 4, a tray horizontal portion 504 having a predetermined width in forward and backward directions and extending in the lateral direction is arranged on the tray rear wall 52 of the sheet discharge tray 50. The upper sheet discharge surface 501 of the sheet discharge tray 50 excluding the tray horizontal portion 504 is inclined downwardly from the tray left wall 53 toward the tray right wall 54. Thus, there is a step between a right end part of the upper sheet discharge surface 501 and that of the tray horizontal portion 504 as shown in FIG. 4.

With reference to FIG. 6, the sheet discharge tray 50 is mounted in front of the rear wall portion 22 and to the left of the side wall portion 23 of the image forming apparatus 1. A rear mounting portion 225 is arranged in a rear inner wall 221 which is a side surface on the front side of the rear wall portion 22. The rear mounting portion 225 extends in the lateral direction in an upper part of the rear inner wall 221. The three mounting pieces arranged on the tray rear wall 52 of the sheet discharge tray 50 are inserted into the rear mounting portion 225. The rear mounting portion 225 includes a first rear mounting portion 225A, a second rear mounting portion 225B and a third rear mounting portion 225C respectively in a left part, a central part and a right part of the rear inner wall 221. These mounting portions are holes formed to extend backward in the rear inner wall 221. The first, second and third rear mounting pieces 521, 522 and 523 are respectively inserted into the first, second and third rear mounting portions 225A, 225B and 225C. In inserting the third rear mounting piece 523 into the third rear mounting portion 225C, the protrusion of the central projecting piece collides with the inner wall of the third rear mounting portion 225C to be elastically deformed. When the third rear mounting piece 523 is completely inserted, the protrusion moves beyond an inner wall portion to be elastically restored, whereby the third rear mounting portion 225C and the protrusion are engaged.

Further, a right mounting portion 255 is arranged in a right inner wall 223 which is a surface on the left side of the side wall portion 23 of the image forming apparatus 1. As described above, the lower and upper sheet discharge openings 251, 252 through which a sheet having a fixing process applied thereto is to be discharged are arranged in the side wall portion 23. The right mounting portion 255 is arranged above the lower sheet discharge opening 251 and below the upper sheet discharge opening 252. The right mounting portion 255 extends along forward and backward directions. The right mounting portion 255 includes a first right mounting portion 255A, a second right mounting portion 255B and a third right mounting portion 255C. These mounting portions are holes formed to extend rightward from the right inner wall 232 and backward in the right inner wall 232.

Further, a recess 213A (second recess) and a stopper 60 (restricting member) are arranged in a left end part of the sheet discharge portion 213 of the image forming apparatus 1. The recess 213A is formed in a central part of the sheet discharge portion 213 in forward and backward directions and in the left end part of the sheet discharge portion 213 by recessing a part of the sheet discharge portion 213 in such a manner as to have a substantially square shape when viewed from above. The stopper 60 is a plate-like member which can be accommodated in the recess 213A. The stopper 60 stands up on a downstream side of the sheet discharge portion 231 in a sheet discharging direction and can come into contact with a downstream end edge of the sheet discharged to the sheet discharge portion 213 in the discharging direction. Unillustrated shaft portions (rotatably supporting portions) arranged on a lower end part of the stopper 60 are inserted into unillustrated holes arranged at a left end part of the recess 213A. As a result, the stopper 60 is rotatably supported about the shaft portions and the position (state) thereof can be changed between a first position where the stopper 60 stands up from the sheet discharge portion 213 and fixes the sheet discharge tray 50 described above and a second position where the stopper 60 is accommodated in the recess 213A. When being rotated upward as shown in FIG. 6, the stopper 60 is in a posture to project upward from the sheet discharge portion 213. At this time, the stopper 60 has a function of preventing a sheet discharged to the sheet discharge portion 213 through the lower sheet discharge opening 251 from dropping from the left side of the sheet discharge portion 213.

Note that an unillustrated stopper member having the same shape as the stopper 60 and slightly smaller than the stopper 60 can be arranged in the upper recess 502 (FIG. 4) of the sheet discharge tray 50 described above. The stopper member is arranged to restrict a movement of a sheet discharged to the upper sheet discharge surface 501 of the sheet discharge tray 50 similarly to the stopper 60.

Figure 7:
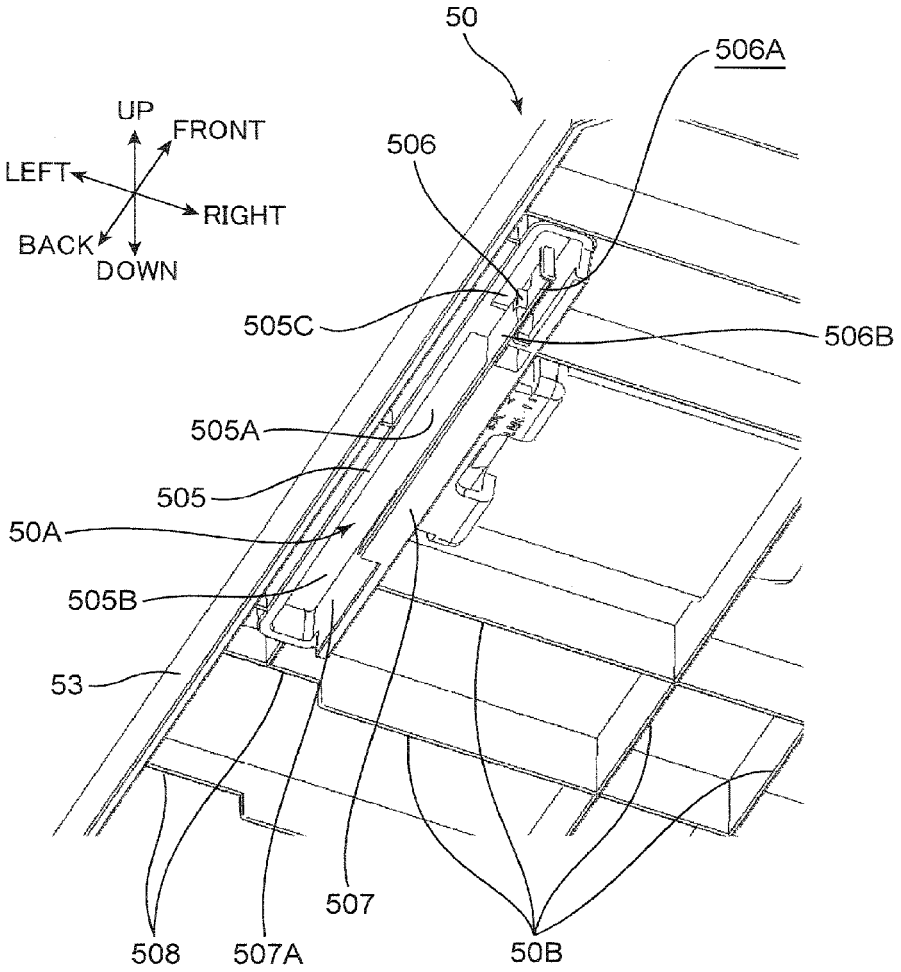
FIG. 7 is an enlarged perspective view of the sheet discharge tray according to the embodiment of the present disclosure.
Figure 8:
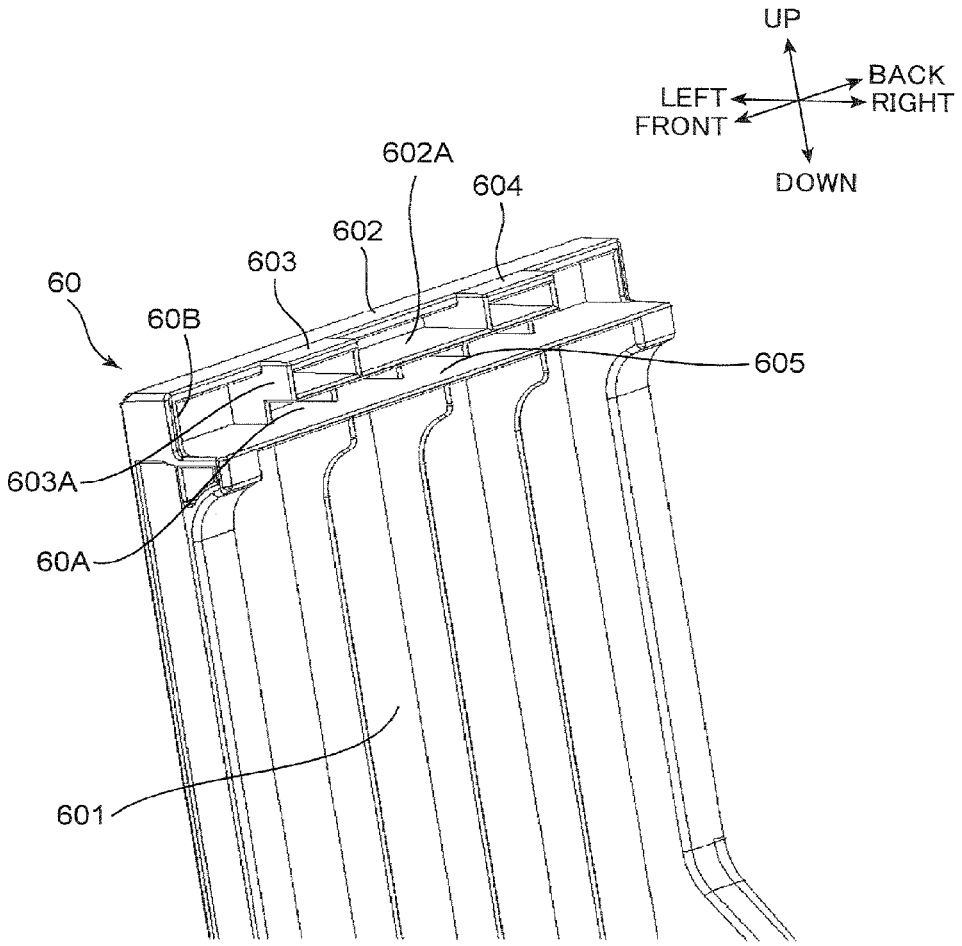
FIG. 8 is an enlarged perspective view of a stopper according to the embodiment of the present disclosure.

In this embodiment, the stopper 60 has a function of fixing the sheet discharge tray 50 and guiding a movement of the sheet discharge tray 50 when the sheet discharge tray 50 is attached to the image forming apparatus 1 in addition to the function of preventing the drop of the sheet as described above. FIG. 7 is an enlarged perspective view of a part of the underside of the tray left wall 53 of the sheet discharge tray 50. FIG. 8 is an enlarged perspective view of an upper end part of the stopper 60 of the sheet discharge portion 213.

With reference to FIG. 7, the sheet discharge tray 50 includes the fixing portion 50A (second fixing portion) on the underside of the upper sheet discharge surface 501 and at the inner side of the tray left wall 53. The fixing portion 50A is fixed to the above stopper 60. The fixing portion 50A includes a guide surface 505, a guide projecting piece 507 (lower wall), a guide wall portion 507A, a projecting plate 506A, an engaging piece 506 and retracted portions 508 (guide portion, first recess). Note that a plurality of ribs 50B extending in forward and backward directions and lateral direction are arranged on the underside of the sheet discharge tray 50 as shown in FIG. 7. The ribs 50B are arranged in flush with the lower end of the tray left wall 53. The rigidity of the sheet discharge tray 50 is improved by the ribs 50B.

The guide surface 505 corresponds to a part of the bottom surface of the above fixing recess 503 (FIG. 5). The guide surface 505 is arranged at a position above the lower end of the tray left wall 53. The guide surface 505 extends in forward and backward directions at the inner side (right side) of and at a predetermined distance from the tray left wall 53. The guide surface 505 is a wall surface having a small width in the lateral direction and facing downward. The guide wall portion 507A is arranged at the right side of and at a predetermined distance from the guide surface 505. The guide wall portion 507A is a wall surface having a predetermined height in the vertical direction and extending in forward and backward directions. The guide projecting piece 507 is a wall portion projecting leftward from the lower end of the guide wall portion 507A in a central part of the guide wall portion 507A in forward and backward directions. The guide projecting piece 507 has a predetermined width in the lateral direction and extends in forward and backward directions. Accordingly, the guide projecting piece 507 is arranged substantially in parallel to the guide surface 505 below the guide surface 505. The guide projecting piece 507 is supported on a supporting surface 605 of the stopper 60 to be described later.

The projecting plate 506A is arranged between the guide surface 505 and the guide projecting piece 507 in the vertical direction. Further, the projecting plate 506A is arranged between the guide surface 505 and the guide wall portion 507A in the lateral direction. The projecting plate 506A is a plate member having a predetermined width in the vertical direction and extending in forward and backward directions at the front side of the guide projecting piece 507. The projecting plate 506A includes a fixed end 506B on a rear end part. A front end part of the projecting plate 506A is a free end. The engaging piece 506 is a projecting piece projecting from the projecting plate 506A. The engaging piece 506 projects leftward from the projecting plate 506A between the fixed end 506B and the front end part of the projecting plate 506A. The engaging piece 506 includes an inclined surface projecting leftward from the rear side toward the front side when viewed from above in FIG. 3 and the front side of the engaging piece 506 is formed by a surface perpendicular to the projecting plate 506A.

Note that a rear fixing portion 505B is formed in a space enclosed by a rear end part of the guide surface 505 and that of the guide wall portion 507A. Further, a central fixing portion 505A (insertion portion) is formed in a space enclosed by a central part of the guide surface 505 in forward and backward directions, the guide wall portion 507A and the guide projecting piece 507. In other words, the guide projecting piece 507 defines the lower side of the central fixing portion 505A. Further, a front fixing portion 505C is formed in a space enclosed by a front end part of the guide surface 505 and the projecting plate 506A. The central, rear and front fixing portions 505A, 505B and 505C are arranged at the rear end side (front side) of the retracted portions 508 to be described later in an attaching direction of the sheet discharge tray 50. Further, a part of the stopper 60 from a first projecting portion 603 to a second projecting portion 604 to be described later is inserted into the central, rear and front fixing portions 505A, 505B and 505C.

The retracted portions 508 are formed by cutting parts of the ribs 50B at the rear side of the fixing portion 50A (downstream side in the attaching direction of the sheet discharge tray 50 to the main housing 2). Thus, the retracted portions 508 are arranged at positions separated upward from the lower end of the tray left wall 53 and the lower ends of the ribs 50B. Further, the retracted portions 508 are arranged in flush with the guide surface 505 in the vertical direction. The retracted portions 508 can slide on a stopper upper end surface 602 of the stopper 60 to be described later.

The above fixing portion 50A of the sheet discharge tray 50 is attached to an upper end part of the stopper 60. With reference to FIG. 8, the stopper 60 includes a stopper main body 601, the stopper upper end surface 602, the first projecting portion 603, the second projecting portion 604, a connecting surface 602A, a supporting surface 605, an engaging surface 603A and an insertion portion 60A.

The stopper main body 601 is a main body part of the stopper 60 and is a plate member having a substantially rectangular shape. The stopper upper end surface 602 corresponds to the upper end edge of the stopper 60 when the stopper 60 is in the posture shown in FIG. 6. The first and second projecting portions 603, 604 are projecting portions projecting rightward from the right edge of the stopper upper end surface 602. The first and second projecting portions 603, 604 respectively project from a central part of the stopper upper end surface 602 in forward and backward directions while being spaced apart by a predetermined distance. Each of the first and second projecting portions 603, 604 has a small rectangular parallelepipedic shape. The connecting surface 602A connects the lower surfaces of the first and second projecting portions 603, 604 in forward and backward directions. Further, the engaging surface 603A is arranged on the front wall surface of the first projecting portion 603. Further, an inner wall surface 60B is arranged on a part of a surface facing the engaging surface 603A corresponding to the underside of the front wall surface of the stopper 60. The engaging piece 506 of the fixing portion 50A of the sheet discharge tray 50 described above is engaged in a space between the engaging surface 603A and the inner wall surface 60B.

The supporting surface 605 is a wall surface having a predetermined width in the lateral direction and extending in forward and backward directions below the first and second projecting portions 603, 604. The supporting surface 605 is arranged in parallel to the stopper upper end surface 602. The insertion portion 60A, which is a predetermined clearance, is formed between the lower surfaces of the first and second projecting portions 603, 604 and the connecting surface 602A and the supporting surface 605. The guide projecting piece 507 of the fixing portion 50A described above is to be inserted into the insertion portion 60A.

<Regarding How to Attach the Sheet Discharge Tray 50>

Figure 9:
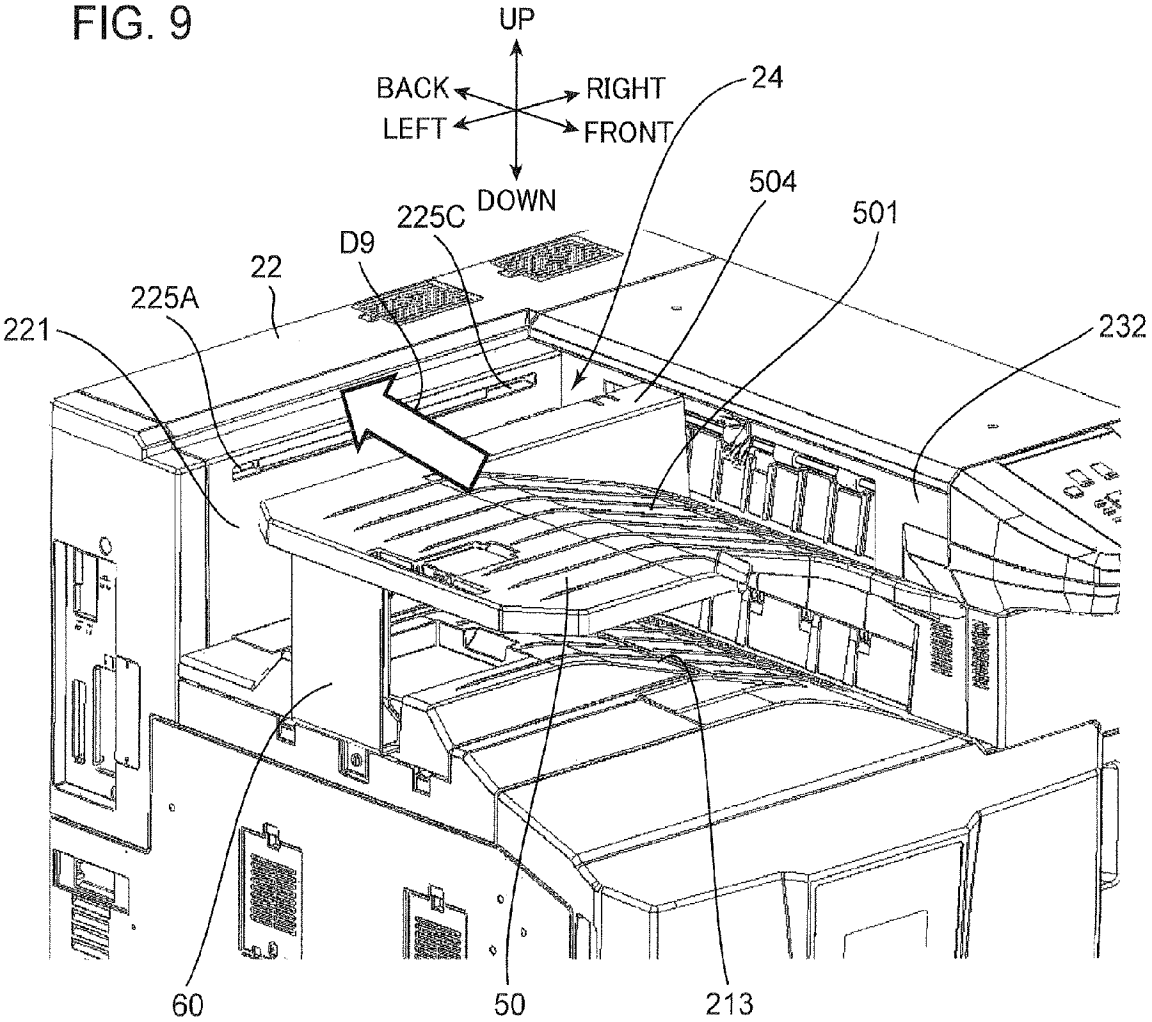
FIG. 9 is a perspective view showing a state where the sheet discharge tray is attached to the image forming apparatus.
Figure 10:
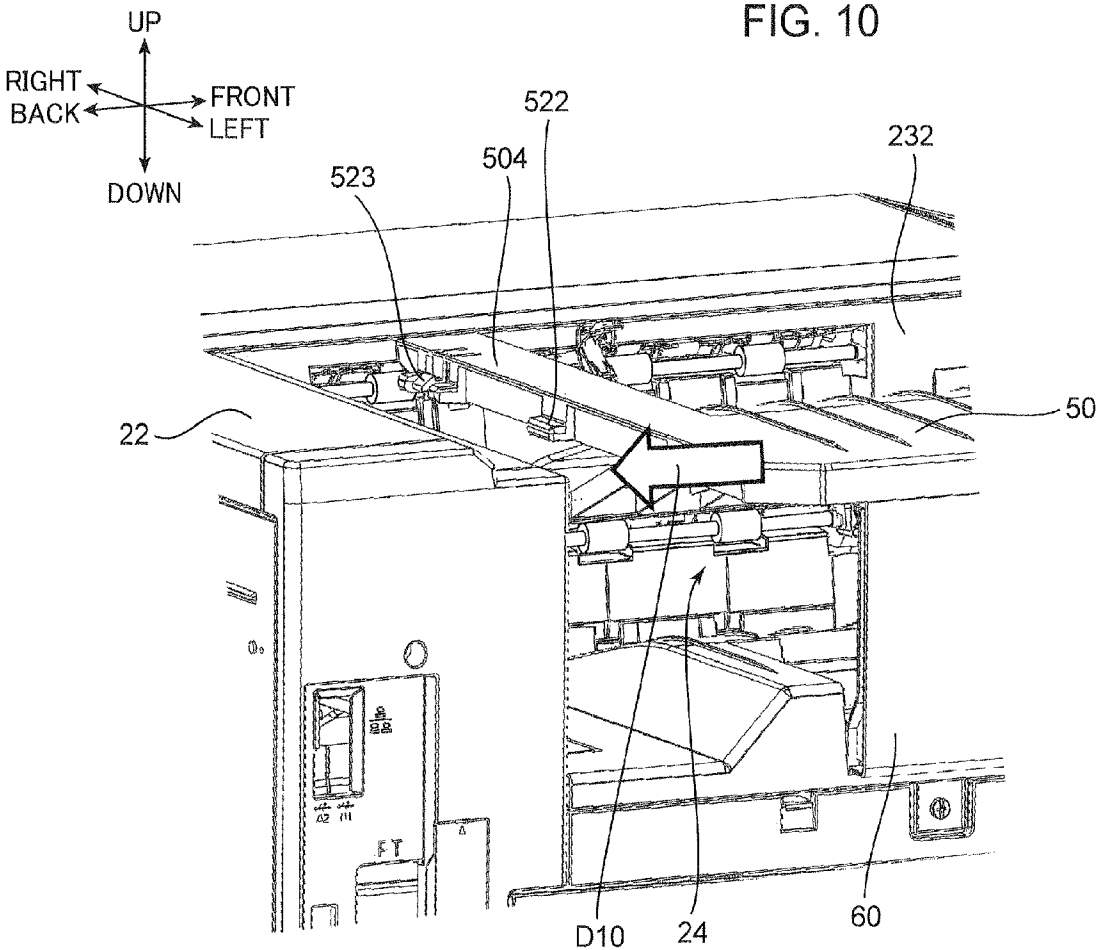
FIG. 10 is a perspective view showing the state where the sheet discharge tray is attached to the image forming apparatus.
Figure 11:
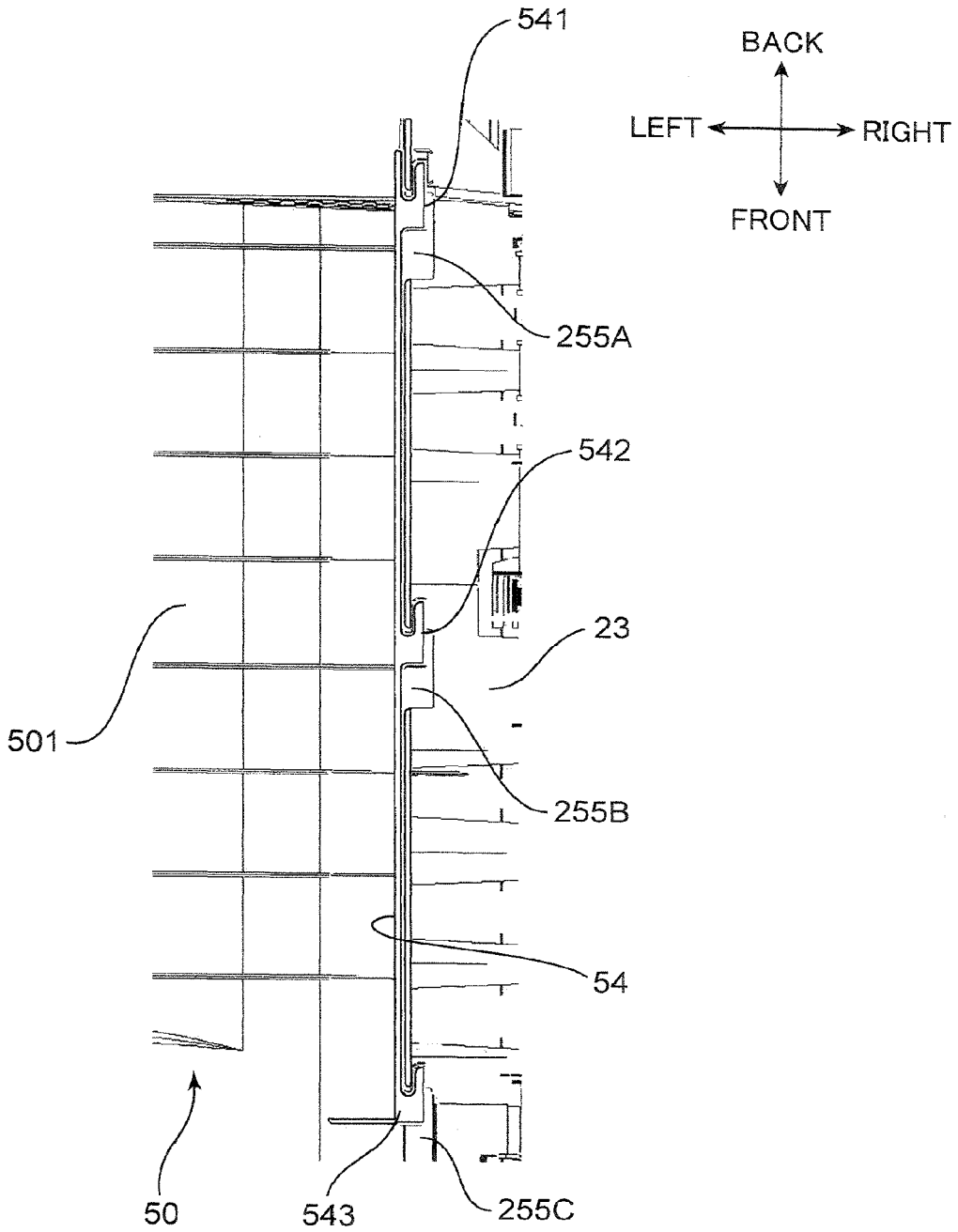
FIG. 11 is a sectional view showing a connected state of the sheet discharge tray to the image forming apparatus.
Figure 12:
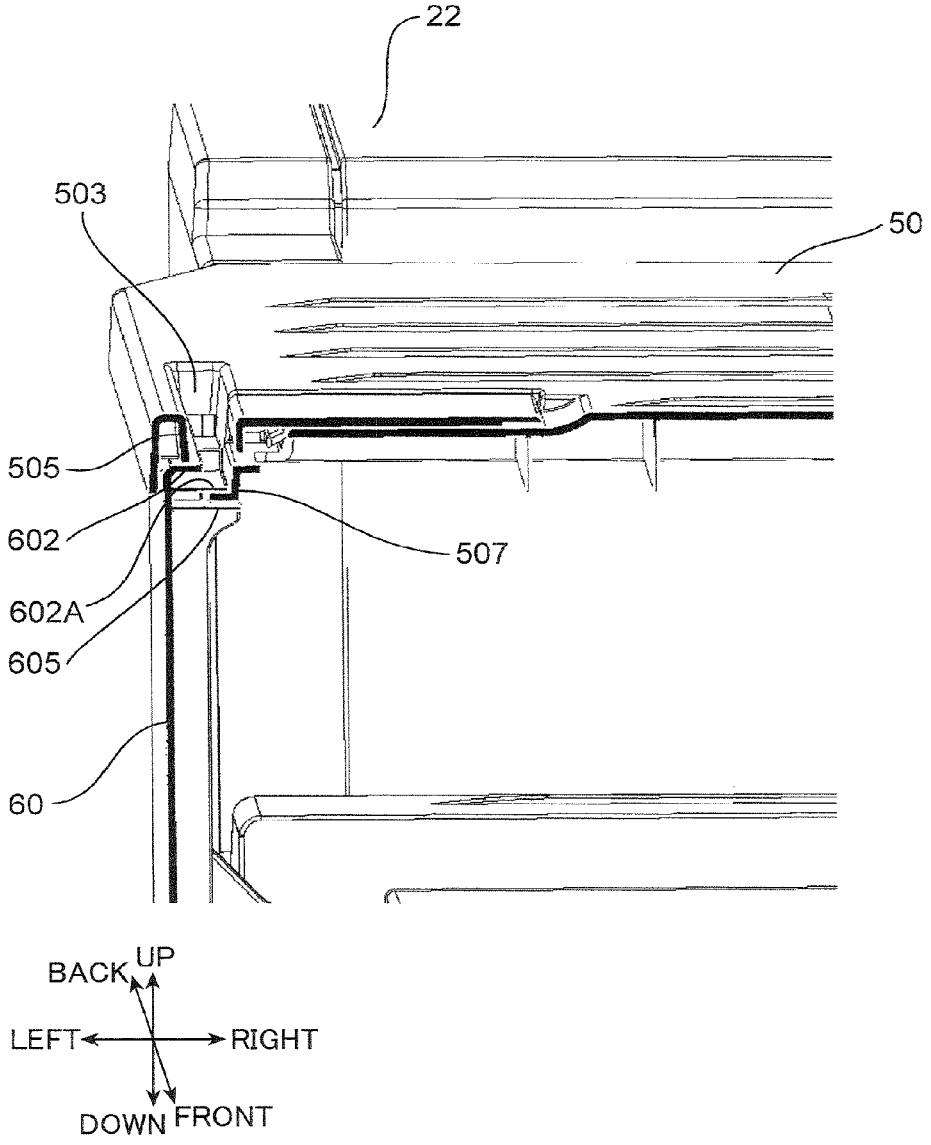
FIG. 12 is a perspective view showing the connected state of the sheet discharge tray to the image forming apparatus.
Figure 13:
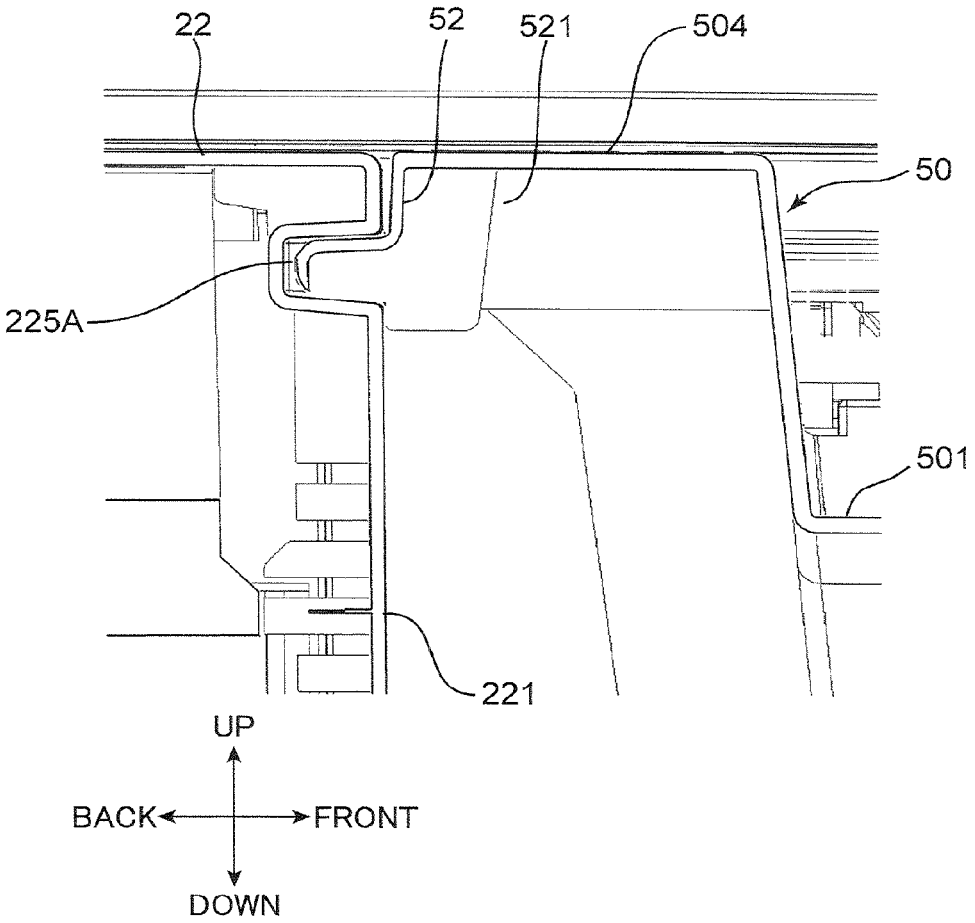
FIG. 13 is an enlarged sectional view showing the connected state of the sheet discharge tray to the image forming apparatus.

Next, how to attach the sheet discharge tray 50 to the image forming apparatus 1 is described with reference to FIGS. 9 to 13 in addition to FIGS. 4 to 8. FIGS. 9 and 10 are perspective views showing a state where the sheet discharge tray 50 is being attached to the image forming apparatus 1. FIG. 11 is a sectional view showing a connected state of the sheet discharge tray 50 to the tray right wall 54. FIG. 12 is a sectional view showing a connected state of the sheet discharge tray 50 and the stopper 60. FIG. 12 shows a state where the sheet discharge tray 50 and the stopper 60 are cut in a central part of the stopper 60 in forward and backward directions. FIG. 13 is an enlarged sectional view showing a connected state of the sheet discharge tray 50 to the tray rear wall 52.

With reference to FIGS. 9 and 10, the sheet discharge tray 50 is inserted into the discharge space 24 of the image forming apparatus 1 (arrow D9). At this time, the tray rear wall 52 (FIG. 5) of the sheet discharge tray 50 is arranged to face the rear inner wall 221. Further, the tray right wall 54 of the sheet discharge tray 50 is arranged to face the right inner wall 232. The sheet discharge tray 50 is attached to the main housing 2 in a direction (backward direction) intersecting with a direction (leftward direction) in which sheets are discharged through the lower and upper sheet discharge openings 251, 252. An assembly worker can move the sheet discharge tray 50 backward while bringing the stopper upper end surface 602 of the stopper 60 into contact with the retracted portions 508 (FIG. 7) of the sheet discharge tray 50. Specifically, the retracted portions 508 have a function of guiding a backward movement of the sheet discharge tray 50. Thus, the assembly worker can insert the first, second and third right mounting pieces 541, 542 and the 543 (FIG. 5) of the sheet discharge tray 50 into the right mounting portion 255 (first, second and third right mounting portions 255A, 255B and 255C) (FIG. 6) arranged in the right inner wall 232 with the left end part of the sheet discharge tray 50 supported on the stopper 60. After the first, second and third right mounting pieces 541, 542 and 543 are respectively inserted into the first, second and third right mounting portions 255A, 255B and 255C, the sheet discharge tray 50 is further pushed backward. As a result, bent leading end parts of the first, second third right mounting pieces 541, 542 and 543 are inserted to the back sides of the first, second and third right mounting portions 255A, 255B and 255C as shown in FIG. 11. As a result, the tray right wall 54 of the sheet discharge tray 50 is fixed to the right inner wall 232.

At this time, as illustrated in FIG. 13, the first, second and third rear mounting pieces 521, 522 and 523 (FIG. 5) of the sheet discharge tray 50 are attached to the first, second and third mounting portions 225A, 225B and 225C of the rear inner wall 221. Particularly, the third rear mounting piece 523 composed of three projecting pieces is attached to and engaged with the third rear mounting portion 225C, whereby the tray rear wall 52 of the sheet discharge tray 50 is fixed to the rear inner wall 221.

On the other hand, the fixing portion 50A of the sheet discharge tray 50 is fixed to the stopper 60 when the tray rear wall 52 is attached to the rear inner wall 221. Specifically, the sheet discharge tray 50 is inserted backward while the retracted portions 508 (FIG. 7) of the sheet discharge tray 50 slide on the stopper upper end surface 602 (FIG. 8) of the stopper 60. Eventually, the first projecting portion 603 projecting rightward from the stopper upper end surface 602 is inserted into the rear fixing portion 505B.

Further, as the sheet discharge tray 50 is moved backward, the first projecting portion 603 is inserted into the central fixing portion 505A. At this time, the guide projecting piece 507 of the fixing portion 50A is inserted into the insertion portion 60A of the stopper 60. Then, as shown in FIG. 12, the lower surface of the guide projecting piece 507 is supported on the supporting surface 605 of the stopper 60. When the sheet discharge tray 50 is further moved backward, the first projecting portion 603 is inserted into the front fixing portion 505C. Then, the first projecting portion 603 is moved while pushing the front end part (free end side) of the projecting plate 506A rightward. Further, the engaging piece 506 (FIG. 7) is arranged to face the inner wall surface 60B in attaching the third rear mounting piece 523 (FIG. 5) of the sheet discharge tray 50 to the third rear mounting portion 225C (FIG. 6) of the rear inner wall 221. As a result, the vertical surface on the front end of the engaging piece 506 and the inner wall surface 60B are arranged to face each other with a predetermined tolerance in forward and backward directions. On the other hand, the free end of the projecting plate 506A at the front side of the engaging piece 506 is arranged at the front side of the stopper 60 and has a function of unlocking (disengaging) the engaging piece 506 and the inner wall surface 60B. In this way, the engaging piece 506 is engaged with the inner wall surface 60B and the fixing portion 50A is fixed to the stopper 60.

<Regarding How to Cool the Discharge Space 24>

Figure 14:
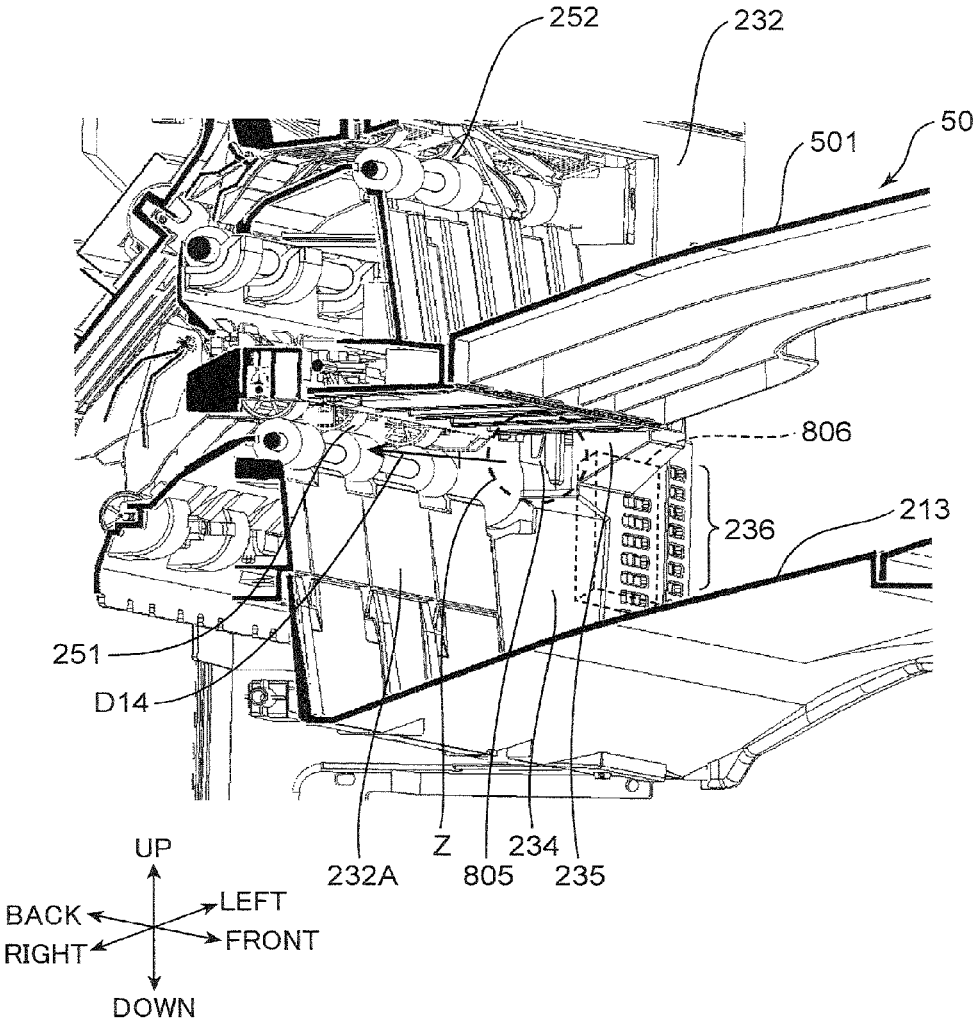
FIG. 14 is a sectional perspective view showing an arrangement of an air outlet according to the embodiment of the present disclosure.
Figure 15:
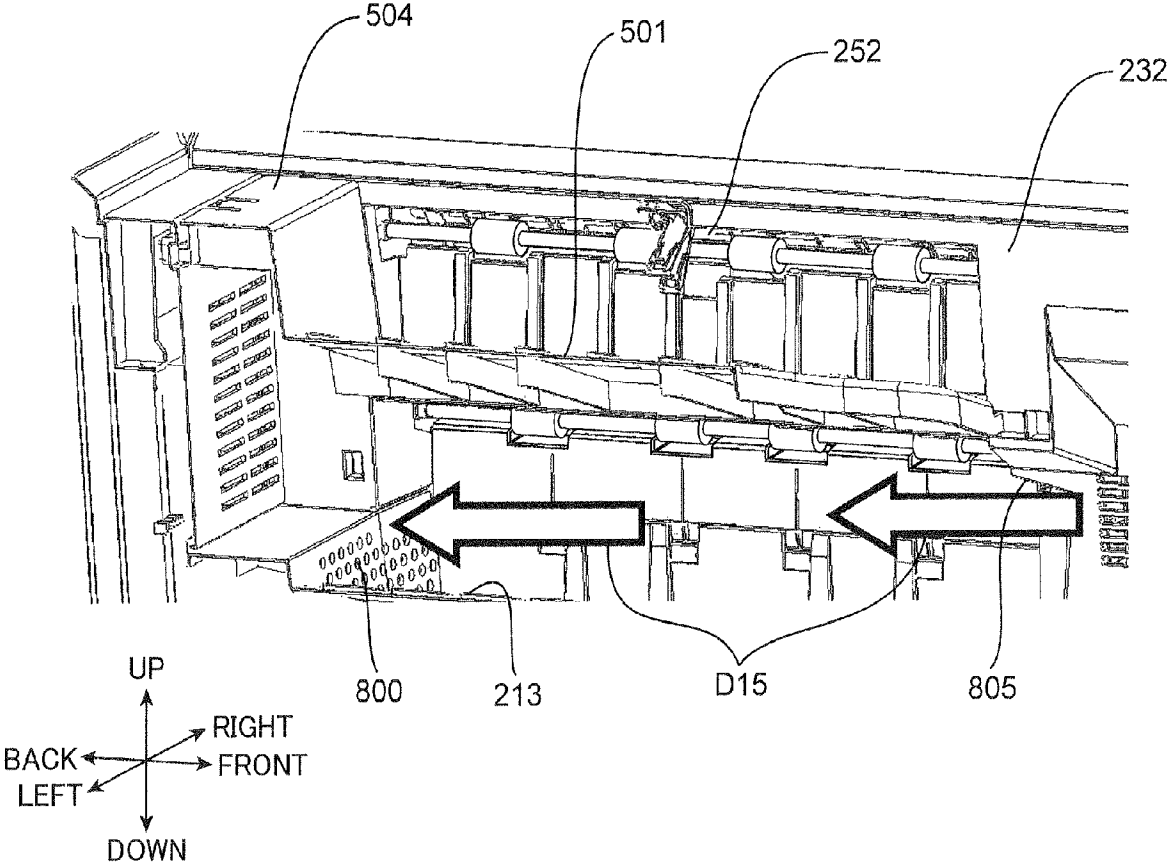
FIG. 15 is a sectional perspective view showing the flow of cooling air.

The sheet discharge tray 50 according to this embodiment further has a function of increasing an effect of cooling a sheet discharged to the discharge space 24 by being attached to the image forming apparatus 1. FIG. 14 is a sectional perspective view showing an air outlet 805 arranged in the right inner wall 232 for the explanation of a cooling mechanism according to this embodiment. FIG. 14 is a view of the image forming apparatus 1 cut along a vertical plane and a lateral plane. FIG. 15 is a sectional perspective view showing the flow of cooling air for cooling a sheet.

With reference to FIG. 14, the image forming apparatus 1 includes a first projecting wall 234, a second projecting wall 235, an air inlet 236, the air outlet 805 (air outlet), a sirocco fan 806 (airflow generator) and a flow inlet 800 (open inlet) (FIG. 15) at the periphery of the right inner wall 232 of the side wall portion 23. Further, a discharge inner wall surface 232A is arranged between the lower sheet discharge opening 251 and the sheet discharge portion 213 described above on the right inner wall 232. The lower sheet discharge opening 251 is arranged on an upper end side of the discharge inner wall surface 232A and the lower end of the discharge inner wall surface 232A is continuous with the sheet discharge portion 213. Further, the sheet discharge tray 50 is attached right above the lower sheet discharge opening 251 and arranged to face the sheet discharge portion 213.

The first projecting wall 234 is a wall portion projecting leftward from the discharge inner wall surface 232A at the front side of the discharge inner wall surface 232A. Further, the second projecting wall 235 is a wall portion projecting more leftward than the first projecting wall 234 above the first projecting wall 234. The second projecting wall 235 is arranged substantially at the same height as the sheet discharge tray 50 when viewed from the sheet discharge portion 213.

The air inlet 236 is arranged at the front side of the second projecting wall 235 and below the right inner wall 232. The air inlet 236 is composed of a plurality of openings formed in the wall surface of the right inner wall 232.

The air outlet 805 is an opening formed in a base end part (right end part) of the second projecting wall 235 (see a part enclosed by broken line Z in FIG. 14) and extending backward in the second projecting wall 235.

The sirocco fan 806 is arranged at the inner side of a lower part of the right inner wall 232 and at the inner side of the first and second projecting walls 234, 235. The sirocco fan 806 includes unillustrated rotating fan and partition wall. When the rotating fan is driven and rotated, an airflow is generated in the right inner wall 232 from the air inlet 236. The airflow has the direction thereof changed by the partition wall in the right inner wall 232 and exits backward from the air outlet 805 as shown by an arrow D14 of FIG. 14 and arrows D15 of FIG. 15.

The flow inlet 800 is formed in a part of the rear inner wall 221 below the sheet discharge tray 50 and lateral to a wedge-shaped space formed by the discharge inner wall surface 232A and the sheet discharge portion 213 (see FIG. 6). The flow inlet 800 is composed of a plurality of holes formed to extend to the inner side of the rear inner wall 221. The flow inlet 800 has a function of sucking air discharged from the air outlet 805 again.

As shown in FIG. 15, the airflow exiting from the air outlet 805 flows into the rear wall portion 22 through the flow inlet 800 (see FIG. 6) while flowing between the upper sheet discharge surface 501 of the sheet discharge tray 50 and the sheet discharge portion 213. The airflow flowed into the rear wall portion 22 is discharged to the outside of the image forming apparatus 1 through an unillustrated discharge opening.

As just described, according to this embodiment, an upper side of an air path of the airflow exiting from the air outlet 805 is defined by the sheet discharge tray 50. Further, a lower side of the air path is defined by the sheet discharge portion 213. Thus, the airflow cools the upper sheet discharge surface 501 of the sheet discharge tray 50 and the sheet discharge portion 213. Thus, even if the temperature of a sheet discharged through the lower or upper sheet discharge opening 251 or 252 has not dropped after the fixing process is applied in the fixing unit 97, the sheet is cooled by the airflow. As a result, it can be suppressed that the toner, which has not yet been solidified on one sheet having passed through the fixing unit 97, adheres to (offset) the underside of another sheet to be placed above the former sheet. Further, the airflow exiting from the air outlet 805 is sucked through the flow inlet 800 arranged in the rear inner wall 221. Thus, the airflow in the attaching direction is stably maintained.

Further, in this embodiment, the sheet discharge tray 50 includes the cut portion 51R to enable a user to easily grab a sheet discharged onto the upper sheet discharge surface 501 as shown in FIG. 5. The cut portion 51R does not communicate with the tray right wall 54 and the upper sheet discharge surface 501 projects forward on the right side of the cut portion 51R, thereby forming the tray projecting portion 51S. The tray projecting portion 51S is arranged to cover a left part of the air outlet 805 from above as shown in FIG. 14. Thus, the airflow exiting from the air outlet 805 stably flows backward and the effect of cooling a sheet discharged to the sheet discharge portion 213 is improved.

Note that the present disclosure is not limited to the above embodiment. For example, the following modifications may be adopted.

(1) In the above embodiment, a plurality of projecting pieces (first rear mounting piece 521, second rear mounting piece 522, third rear mounting piece 523, first right mounting piece 541, second right mounting piece 542, third right mounting piece 543) are arranged on the sheet discharge tray 50 to fix the sheet discharge tray 50 to the rear wall portion 22 and the side wall portion 23. Further, the rear mounting portion 225 and the right mounting portion 255 are arranged as a plurality of openings in the rear wall portion 22 and the side wall portion 23. The present disclosure is not limited to this. A plurality of openings may be formed in the tray rear wall 52 and the tray right wall 54 of the sheet discharge tray 50 and a plurality of projecting pieces may project from the rear wall portion 22 and the side wall portion 23.

(2) In the above embodiment, the retracted portions 508 are described to be formed by cutting parts of the ribs 50B in arranging the retracted portions 508 on the lower surface of the sheet discharge tray 50. The present disclosure is not limited to this. Specifically, the lower surface of the sheet discharge tray 50 may be a flat surface and the retracted portions 508 may be recesses formed by recessing parts of the flat surface.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. An image forming apparatus, comprising:

a housing with a standing wall;

an image forming unit which is arranged in the housing and forms an image on a sheet;

a first discharge opening and a second discharge opening above the first discharge opening, which are arranged on the standing wall while being vertically spaced apart and through which the sheet having the image formed thereon is selectively discharged from the interior of the housing;

a sheet discharge portion which is connected to the standing wall at a position below the first discharge opening and on which the sheet discharged through the first discharge opening is to be placed;

a restricting member which stands up on a downstream side of the sheet discharge portion in a discharging direction of the sheet and which comes into contact with a downstream end edge of the sheet discharged to the sheet discharge portion in the discharging direction;

a sheet discharge tray which includes a first fixing portion to be fixed to the standing wall and a second fixing portion to be fixed to an upper end part of the restricting member and is attachable above the sheet discharge portion and on which a sheet discharged through the second discharge opening is to be placed;

an air inlet arranged at a rear end side of the standing wall in an attaching direction of the sheet discharge tray to the housing;

an air outlet formed on the standing wall and extending toward a leading end side in the attaching direction below a rear end side of the sheet discharge tray in the attaching direction; and an airflow generator arranged in the standing wall and discharging from the air outlet air that has been sucked through the air inlet, wherein the sheet discharge portion includes a recess at a downstream side in the discharging direction; and a state of the restricting member is changed between a first position where the restricting member stands up from the sheet discharge portion and fixes the sheet discharge tray and a second position where the restricting member is accommodated in the recess.

2. An image forming apparatus according to claim 1, wherein:

the restricting member includes a rotatably supporting portion that is rotatable relative to the sheet discharge portion and is movable between the first position and the second position by rotating about the rotatably supporting portion.

3. An image forming apparatus according to claim 2, wherein:

the sheet discharge portion defines the upper surface of the housing above the image forming unit;

the standing wall stands up from one side edge of the sheet discharge portion;

the image forming apparatus further comprises a side wall portion that stands up from another side edge intersecting with the one side edge of the sheet discharge portion; and the sheet discharge tray includes a third fixing portion to be fixed to the side wall.

4. An image forming apparatus according to claim 3, further comprising:

an open inlet arranged on the side wall at a position below the sheet discharge tray and sucks the air discharged from the air outlet again.

5. An image forming apparatus according to claim 3, wherein:

the sheet discharge tray includes:

an inclined surface inclined down from a downstream area in the discharging direction toward the standing wall, and a side wall facing portion that is continuous with a leading end side of the inclined surface in the attaching direction and includes a horizontal upper end part and is arranged to face the side wall;

the third fixing portion is a projecting piece projecting from the side wall facing portion toward the side wall; and the side wall includes an opening into which the projecting piece is to be inserted.

6. An image forming apparatus according to claim 5, wherein:

a plurality of horizontally spaced projecting pieces; and the side wall includes a plurality of openings into which the plurality of projecting pieces are to be inserted.

7. An image forming apparatus, is comprising:

a housing with a standing wall;

an image forming unit arranged in the housing and forming an image on a sheet;

a first discharge opening and a second discharge opening above the first discharge opening, the first and second discharge openings being arranged on the standing wall while being vertically spaced apart and through which the sheet having the image formed thereon is selectively discharged from the interior of the housing, a sheet discharge portion that is connected to the standing wall at a position below the first discharge opening and on which the sheet discharged through the first discharge opening is to be placed, a restricting member that stands up on a downstream side of the sheet discharge portion in a discharging direction of the sheet and that comes into contact with a downstream end edge of the sheet discharged to the sheet discharge portion in the discharging direction;

a sheet discharge tray that includes a first fixing portion to be fixed to the standing wall and a second fixing portion to be fixed to an upper end part of the restricting member and is attachable above the sheet discharge portion and on which a sheet discharged through the second discharge opening is to be placed, an air inlet arranged at a rear end side of the standing wall in an attaching direction of the sheet discharge tray to the housing;

an air outlet formed on the standing wall to extend toward a leading end side in the attaching direction below a rear end side of the sheet discharge tray in the attaching direction; and an airflow generator arranged in the standing wall and discharging from the air outlet air that has been sucked through the air inlet.

8. An image forming apparatus according to claim 7, wherein:

the sheet discharge tray includes:

a cut portion formed by cutting a part of an end edge at the rear end side in the attaching direction; and a tray projecting portion that defines an end part of the cut portion at the standing wall side and covers the air outlet from above.

* * * * *